United States Patent [19]

Lefebvre

[11] Patent Number: 4,707,590

[45] Date of Patent: Nov. 17, 1987

[54] IMMERSION HEATER DEVICE

[76] Inventor: Fredrick L. Lefebvre, 700 Solano Prada, Coral Gables, Fla. 33156

[21] Appl. No.: 832,823

[22] Filed: Feb. 24, 1986

[51] Int. Cl.[4] ..... H05B 3/06; H05B 3/02

[52] U.S. Cl. ..... 219/523; 219/316; 219/318; 219/331; 219/335; 219/336; 338/214

[58] Field of Search ..... 219/316, 318, 335, 336, 219/523, 331; 338/214

[56] References Cited

U.S. PATENT DOCUMENTS

| | | | |
|---|---|---|---|
| 3,382,346 | 5/1968 | Breuer et al. | 219/331 |
| 3,952,182 | 4/1976 | Flanders | 219/309 |
| 4,551,619 | 11/1985 | Lefebvre | 219/523 |

*Primary Examiner*—Clifford C. Shaw

*Assistant Examiner*—Gerald E. Preston

*Attorney, Agent, or Firm*—Watts, Hoffmann, Fisher & Heinke

[57] ABSTRACT

The present invention relates to the technical field of fluid heater devices, and more particularly to an electric immersion heater for use in electro-plating, metal preparation, finishing applications in the electronics industry (e.g. preparation of printed circuits). The invention more specifically provides a new and improved electric immersion heater design that includes, in combination, a unique flexible cable structure enabling small diameter coils (made primarily from a fluoroplastic material) which, in turn, are mounted on a support frame structure. This provides an inexpensive heater assembly that has optimum heat transfer capability in liquid treating mediums.

10 Claims, 10 Drawing Figures

IMMERSION HEATER DEVICE

TECHNICAL FIELD

The present invention relates to the technical field of fluid heater devices, and more particularly to an electric immersion heater for use in electro-plating, metal preparation, finishing applications in the electronics industry (e.g. preparation of printed circuits). The invention more specifically provides a new and improved electric immersion heater design that includes, in combination, a unique flexible cable structure enabling small diameter coils (made primarily from a fluoroplastic material) which, in turn, are mounted on a support frame structure. This provides an inexpensive heater assembly that has optimum heat transfer capability in liquid treating mediums.

RELATED APPLICATIONS AND PATENTS

This application relates to applicant's U.S. Pat. No. 4,551,619 filed Jan. 22, 1985 and granted Nov. 5 1985, the disclosure of which is fully incorporated herein by reference.

BACKGROUND OF THE INVENTION

Heretofore, it has been known to provide various immersion heater designs to heat various corrosive liquids in tanks of the type utilized in the plating and semiconductor industries. Such immersion heaters have generally included a resistance wire with a ceramic insulator assembly disposed in a sheath of material generally resistant to the liquid medium being heated. For a general background of various prior heaters of the immersion type reference may be had, for example, to applicant's aforementioned prior U.S. Pat. No. 4,551,619 and the patents cited therein.

The various problems attendant in prior immersion heaters made from fluoroplastic materials, such as TEFLON or the like, in respect to corrosion resistance and the ability to be economically produced are set forth in applicant's aforementioned application Ser. No. 693,149, U.S. Pat. No. 4,551,619.

Similarly, in applicant's above U.S. Pat. No. 4,551,619 there is disclosed a general background of the problems which occur when heating various types of corrosive liquids in tanks. For example, as used in plating of various articles as well as in preparing articles for plating and similar processes—the liquids being both acid and alkaline, as well as corrosive in many applications.

Accordingly, the present invention provides a new and less costly immersion heater design which consists of small diameter coils of flexible fluoroplastic cable of the general type disclosed and claimed in applicant's aforementioned U.S. Pat. No. 4,551,619. This enables novel heater configurations thereof in conjunction with support frame structures that are of a simple yet rugged construction and which can be economically produced in a variety of configurations, especially for relatively small size plating tanks, as may be utilized in the semiconductor and metal finishing industries.

For reference to prior type devices utilizing TEFLON type materials in immersion heater applications, reference may be had to U.S. Pat. Nos. 3,657,520, 3,663,779, 4,158,764 and 4,390,776.

SUMMARY OF THE INVENTION

The present invention relates to a new and novel immersion heater design for metal plating, preparation and finishing operations and which is especially adapted for application in the semi-conductor industry. The immersion heater device of the invention comprises, in combination, a continuous coiled cable structure having a predetermined small diameter of approximately 1 inch or less made from a fluoroplastic material in conjunction with a support frame structure which is made from a chemical and heat resistant material with the cable structure being of a small helically coiled configuration and being mounted on said frame structure for optimum heat transfer to a liquid heating medium. This invention comprises a cable including a sheath made from a relatively thin layer of polymeric material disposed in close fitting relation around the heater wire element and substantially throughout its length. A conductive ground wire element or metal foil is disposed adjacent to and extends substantially along the length of the sheath, and a barrier layer of high temperature resistant insulation material is disposed to encapsulate the ground wire or foil substantially throughout its length thereof. An outer tubular sheath made from a fluoropolymeric material is disposed in encompassing relation around the insulating layer substantially throughout its length to provide the final cable structure.

In the present invention, the continuous cable structure is configured in the form of small helical coil shapes that include a plurality of axially spaced coils, the coils being mounted in a predetermined orientation on the support frame structure. The support frame structure member is made from chemical and heat resistant material, and with the coil elements disposed in a predetermined pattern on the frame member for selectively heating the liquid heating medium upon energization from the power source. In a preferred form, the frame member has retainer means for detachably mounting the cable element thereon.

By this construction and arrangement, there is provided a simple yet rugged immersion heater device which is relatively economical to produce. Because of the flexibility and small diameter coils of the fluoroplastic heater cable, the immersion heater assembly is relatively easy to form into a variety of sizes and shapes. In the invention, it is believed that by reason of the reliability and yet low cost, the immersion heater assembly of the invention may be treated simply as an "expendable" product without the justification to repair the device after prolonged usage.

The heater assembly of this invention, due to the small diameter of the heater cable, avoids the "breather" problems associated with most other electric immersion heaters when used with tank temperature controls. Specifically, the heater alloy wire reaches very high temperatures in the "on" position causing a near vacuum condition in the heater body. This is followed by a cooling to the tank temperature in the "off" position. The resultant "breather" action is very detrimental especially for electric immersion heaters used in the metal finishing and printed circuit tanks because of the surrounding corrosive and electrically conductive fumes. Accordingly, the immersion heater assembly of this invention uses a predetermined reduced diameter heater cable which for all practical purposes has no "body" and therefore no "breather" action of any consequence.

Other advantages and objects of the invention will become apparent as the following description proceeds when taken in conjunction with the accompanying drawings:

DESCRIPTION OF THE PREFERRED EMBODIMENTS

Figure 1:
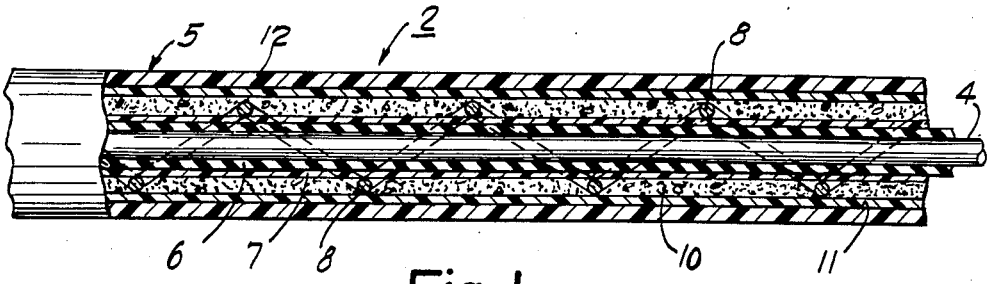
FIG. 1 is a fragmentary, horizontal section view, on an enlarged scale, illustrating the heater cable structure of the present invention.

Referring now again to the drawings and in particular to FIG. 1, there is illustrated the type of flexible cable structure, designated generally at 2, which may be utilized in the present invention. The cable structure 2 includes an electrical heater wire 4 extending longitudinally through the structure. The heater wire 4 may be of the solid electrical resistance type made of a good heat transmitting metal alloy material, such as an iron-nickel alloy. The heater wire, for example, may be 18 gauge (American or Browne & Sharp) having a diameter of approximately 0.04 inches.

As shown in applicant's prior U.S. Pat. No. 4,551,619, the cable structure 2 preferably includes a fibrous paper (arimid) layer, as at 7, disposed around the fluoropolymeric layer 6 that acts as a mechanical shield to prevent the ground wire 8 from gouging into the inner polymeric layer.

An electrical ground wire or metal foil 8 is disposed adjacent to the shield layer 7 throughout its length thereof. The ground wire or foil 8 may be helically disposed with about two to six turns per foot. Also, the ground wire or foil 8 may be disposed to extend linearly in the cable structure or in any other configuration as may be desired In this invention, and as indicated in U.S. Pat. No. 4,551,619, it is important that the ground wire or foil be continuous and extend without interruption throughout the length of the cable structure, so as to comply with most Regional and National Electrical Codes.

Now in the invention, the fluoropolymeric coated heater wire and ground wire or foil 8 are encapsulated with a barrier layer 10 which acts as a fill and is sized so as to completely encapsulate the outside diameter of the ground wire or foil thereby to provide a substantially uniform support for the outer sheath 12 of fluoropolymeric material. The barrier layer 10 of fill material is preferably made of a high temperature resistant material such as fibrous glass material, arimid (aromatic polymide) paper, such as that sold under the trade name NOMEX by the Dupont Corporation or an alumina-silica ceramic paper such as that sold under the name of FIBERFRAX by the Carburundum Corporation. This barrier layer 10 of fill material acts as a mechanical shield over the ground wire 8 during the final application (e.g. extrusion) of the outer polymeric sheath 12. The outer fluoropolymeric tubular sheath 12 is then extruded over the barrier layer of fill material 10 to provide the continuous final composite cable structure.

An outer shield layer, as at 11, made from a fibrous material, such as arimid paper, may be disposed around the barrier layer 10. It will be understood, however, that the barrier layer 10 may be omitted and the outer layer 11 applied directly over and around the ground wire or foil 8, as desired.

Referring to FIG. 1, the outer fluoropolymeric tubular sheath 12 preferably has a wall thickness in the range between 0.01 inches and 0.025 inches with the heater wire having a diameter in the range between 0.01 inches and 0.04 inches to provide a maximum overall cable diameter of $\frac{1}{8}$ inch or less and thereby enabling a maximum heat capacity up to 9 watts/sq.in. of surface area. Therefore, the finished heater cable when coiled would have a bend radius of $\frac{1}{2}$ inch or less so as to be formed into 1 inch or less diameter coils, and with substantially no internal voids so as to reduce a detrimental "breather" action.

Figure 2:
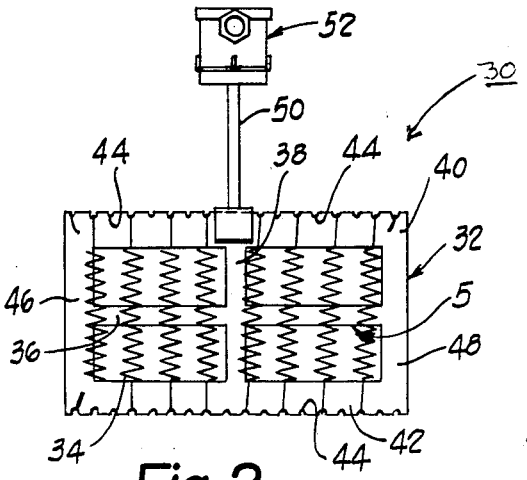
FIG. 2 is a front elevation view illustrating a "pancake" style immersion heater assembly of the present invention.
Figure 3:
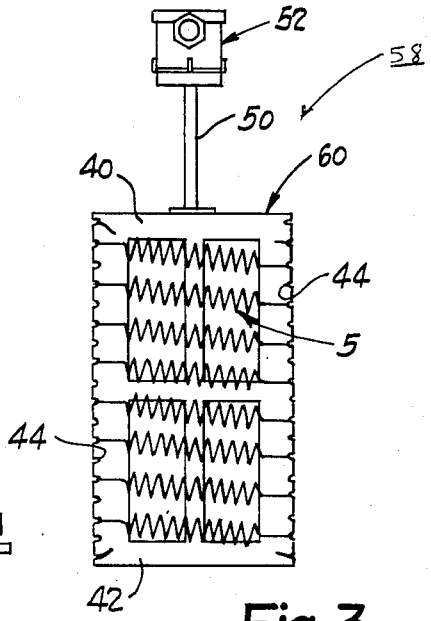
FIG. 3 is a front elevation view of a modified form of the "pancake" style immersion heater assembly of the invention.

In accordance with the invention, the cable structure 5 is utilized, in one embodiment (the pancake style), to provide an electric immersion heater assembly 30, as illustrated in FIG. 2. In this form, the assembly 30 includes a flat, polygonal (e.g. rectangular) shaped support frame member 32 which is of a generally flat construction made from a fluoropolymeric material or other chemical and heat resistant material. The frame member 32 has a window-like opening 34 with integral horizontal 36 and vertical 38 bridging elements which give lateral support and strength characteristics to the frame member 32. In this form, the frame member 32 may be provided on its top 40 and bottom 42 portions with a series of laterally spaced notches, as at 44, disposed to receive, in retaining relation, the uncoiled ends of the cable structure 5, as at 2 in FIG. 1. Accordingly, in this form, the cable structure 5 is helically coiled with the coils being mounted and retained on the frame member 32 in the form of a bed-spring configuration with the individual coils being laterally spaced apart and extending generally parallel to the end portions 46 and 48 of the frame member. For example, in the embodiment shown, eight of the helically coiled cables 5 may have a length of approximately 5 to 6 inches disposed on both sides of the support member 32 and are electrically wired, in series, for connection to a power source. The two free ends of the coiled cables would be brought through the hollow riser member 50 to the junction box 52 for connection to a power source, as known in the art. The free ends of the coiled cable would then be joined by soldering or the like, as disclosed in applicant's aforementioned U.S. Pat. No. 4,551,619. In this form, the tubular riser 50 is integrally attached at one end to the frame member 32 to provide a bayonet type of "L" type immersion heater assembly. The riser is attached at the other end to the junction box 52 for being mounted on an immersion tank, as illustrated in FIG. 3 of applicant's aforementioned U.S. Pat. No. 4,551,619.

As a typical example, the frame member 32 may have a thickness of approximately 3/16 inches with a width of approximately $6\frac{3}{4}$ inches and a length of approximately $13\frac{1}{2}$ inches. Such size and configuration may be utilized for 4 KW and 6 KW immersion heaters with approximately one-half this size utilized for 1 KW, 2 KW and 3 KW assemblies. Also, assemblies for larger than 6 KW heaters may be provided simply by grouping the frame members in end-to-end relation, in a sandwiched relationship or in any combination thereof so that the terminal ends of the coiled cable structure can be led to the junction box for connection to a power source.

In the invention, the $\frac{1}{8}$ inch cable structure 5 to provide the bed-like spring configuration is close wound (e.g. contacting) throughout its length. This may be achieved on a mandrel (e.g. $\frac{3}{8}$ to $\frac{1}{2}$ inchs) so as to give a predetermined ohmage for a particular KW heater application. The cable structure 5 is then axially stretched approximately 1 inch for every 2 to 3 inches of the close wound (contacting) coil to provide the bed-like spring configuration shown and that has a self-supporting structure for an axial length of six inches or less. As finished, the cable per se has a maximum diameter of $\frac{1}{8}$ inch with the individual turns having an unsupported diameter of one (1) inch and with an axial spacement (axial stretch) of approximately one-fourth ($\frac{1}{4}$) to one (1) inch between centers of adjacent turns. The generally helically coiled cable 5 structure is then mounted on one or both sides of the support frame member 32, as aforesaid.

In the invention, due to a soft annealed condition of the heater wire 4, the finished coiled cable 5 (as stretched) has the individual coils axially spaced apart a distance in the range between 2:1 to 5:1 in respect to the ratio of the $\frac{1}{8}$ inch maximum outside diameter of the cable. That is, for a 6 inch coiled cable length with a $\frac{1}{8}$ inch cable diameter, the axial distance between adjacent coils would be $\frac{1}{4}$ inch to $\frac{5}{8}$ inch.

In FIG. 3 there is illustrated a different arrangement of the assembly 58 wherein like reference numerals refer to like parts throughout. In this form, however, the support frame member is of a flat, polygonal (e.g. rectangular) configuration extending in the length-wise direction as opposed to the width-wise direction illustrated in FIG. 3.

Figure 4:
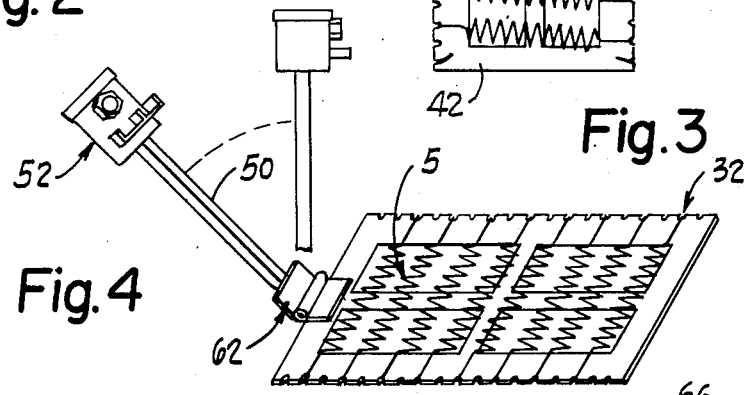
FIG. 4 is a generally perspective view of an immersion heater assembly illustrating a pivotal, living-hinge construction of the present invention.

In FIG. 4, the tubular riser 50 is attached to the frame member 32 by means of a flexible hinge element 62. The hinge element 62 may be in the form of what is termed a "living hinge" construction made from a polypropylene material. This "living hinge" construction allows the riser member 50 to be disposed in a substantially flat orientation to facilitate storage and/or shipping of an L-type immersion heater assembly.

Figure 5:
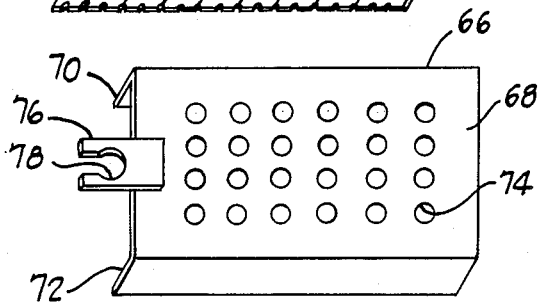
FIG. 5 is a generally perspective view of one form of a guard for an immersion heater assembly of the present invention.
Figure 6:
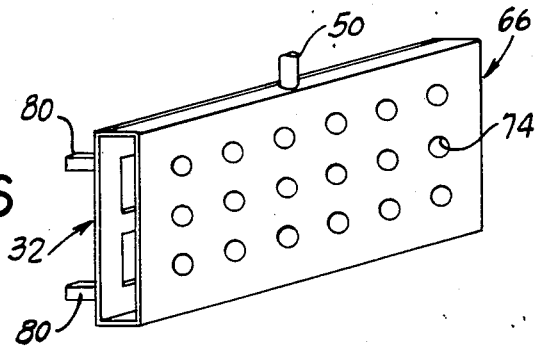
FIG. 6 is a generally perspective view illustrating further detail of the guard of the present invention.

In FIGS. 5 and 6 there is illustrated a guard or shield member 66 which may be placed over and around the support member 32 for protecting the heater cable structure 5. In the form shown, the guard member 66 may be of a generally U-shaped configuration with a base portion 68 having a pair of integral, laterally spaced and outwardly extending legs 70 and 72 which may be suitably attached to the frame member 32. The base portion 68 may be provided with a plurality of apertures, as at 74, to maximize the heat flow from the heater cable coils to the liquid treating medium. As shown in FIG. 5, the cover member 66 may be provided with an integral clamp element 76 having a key-hole opening 78 adapted to receive the tubular riser 50 (FIG. 3) when the L-type riser is utilized with the "living hinge" construction. The snap-type clamp 76, therefore, retains the riser rigidly when in the upright position thereof. As illustrated in FIG. 6, the frame member 32 may be provided on its back side with suitable mounting legs, as at 80. The legs 80 act to space the assembly away from the confronting interior sidewall of the treating tank.

Figure 7:
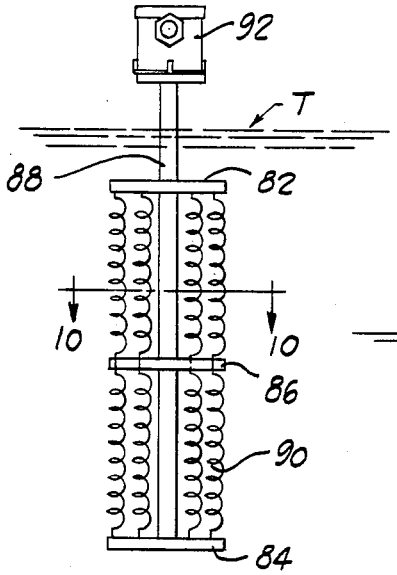
FIG. 7 and FIG. 8 show two versions of a "squirl cage" style immersion heater coil assembly.
Figure 8:
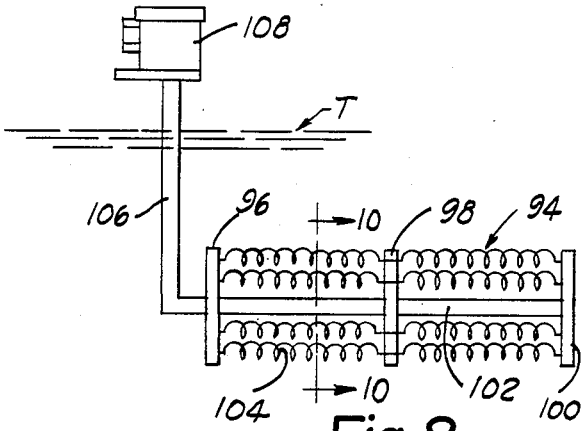
Figure 10:
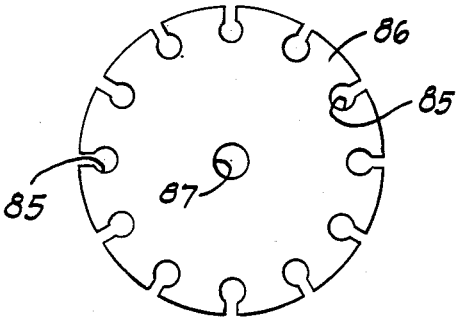
FIG. 10 is a top plan view of a support disc looking in the direction of line 10—10 of FIG. 7.

In FIGS. 7 and 8, there is illustrated another embodiment of the invention generally referred to as the "bayonet" style heater assembly, as distinguished from the "pancake" style illustrated in FIGS. 2 and 3. In this form, the coiled cable structure, as at 90, is disposed in a cylindrical configuration and supported by circular disc members 82, 84 and 86 that are carried by a cylindrical pipe or riser member 88. The riser 88, in turn, supports the junction box, as at 92, for connection to a power source, as known in the art. As seen in FIG. 10, the disc members (82, 84, 86) are spaced apart in an axial direction so as to provide a predetermined spacement and hence, support for the coiled cable structure 90. The disc members are provided with generally key-hole shaped notches, as at 85, so as to slideably receive and retain the cable structure therein. The disc members may be provided with suitable openings, as at 87, to receive the supporting pipe or riser 88 therethrough. The discs may be of any circular or noncircular shape, such as polygonal or the like.

As illustrated in FIG. 8, the "bayonet" style assembly may have a generally L-shaped configuration with the coiled cables, as at 94, being cylindrically and axially supported via disc members 96, 98 and 100. Here again, the disc members are carried by a supporting pipe or riser 102 that may be connected to another riser or stem 106 for connection to a power source via the junction box 108. The assemblies of FIGS. 7 and 8 may then be detachably connected to the sidewall of the liquid treating tank, as at T, in a manner known in the art.

Figure 9:
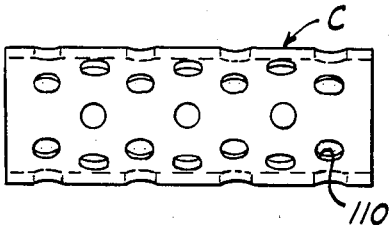
FIG. 9 shows a perforated pipe guard for the above assembly.

In FIG. 9, there is illustrated a cylindrical cover member, as at C, having a hollow elongated configuration and having a length sufficient to cover and hence, protect the cylindrical "bayonet" style assembly as illustrated in FIGS. 7 and 8. The cover may be provided with a plurality of generally symmetrically oriented aperatures, as at 110, to maximize heat transfer from the heater coils to the liquid medium contained in the treating Tank.

The cover member may be of any suitable shape depending on the shape of the disc members. For example, the cover would conform in shape to the shape of the disc.

In the invention, the component parts for the supporting members and tubular risers including the cover and spacer disc members may be made from chemical and heat resistant polymeric materials such as fluoropolymeric materials, chlorinated polyvinyl chloride, polypropylene and the like. The heater assembly is, therefore, highly reliable and efficient and yet can be inexpensively produced to provide, in effect, a "throw-away" heater unit which can be quickly and easily replaced with a minimum of time and effort. Accordingly, it will be understood that various configurations and sizes of the heater coil assemblies may be provided dependent upon the desired application and KW requirement for a particular application. Also, it will be recognized that the tubular risers or stems, as at 50, can be utilized in the form of flexible electrical leads wherein semi-conductor industry consoles are utilized, for example.

Other advantages and objects of the present invention are contemplated within the appended claims.

I claim:

1. An electric immersion heater assembly having a relatively small, portable construction and having good temperature and corrosion resistant characteristics for use in metal finishing, metal plating and metal preparation applications, the assembly being made of a generally all plastic construction adapted for ready throw-away usage, the assembly comprises, in combination, a flexible cable structure and a frame structure adapted for operably mounting said cable structure interiorly of a treating tank containing a liquid heating fluid, said cable structure having a maximum diameter not substantially greater than $\frac{1}{8}$ inch including an electric metallic heater wire element adapted for connection to a power source, a sheath made from a relatively thin layer of fluoropolymeric material disposed in close fitting relation around said heater wire element throughout its length thereof, a conductive metallic ground wire element disposed in engagement with and extending throughout the length of said sheath, an insulating barrier wire of high temperature insulation encapsulating said ground wire element throughout its length thereof, an outer tubular sheath made from a fluoropolymeric material disposed in encapsulating relation around said insulating barrier layer substantially throughout its length to provide said cable structure, the improvement comprising the said cable structure being made into a plurality of individual coil members each having a series of axially spaced coil turn elements defining a self-supporting, spring-like configuration, said cable structure having said maximum $\frac{1}{8}$ inch diameter with the coil turn elements each having an outside diameter greater than $\frac{1}{8}$ inch and up to 1 inch with said coil turn elements being axially spaced apart in the range between 2:1 to 5:1 in respect to the ratio of the said $\frac{1}{8}$ inch maximum outside diameter of said cable structure, said support frame structure including at least one frame member made from a polymeric material, said spring-like coil turn elements being connected in supported relation on said frame member and laterally spaced from one another, adjacent ends of said coil turn elements being integrally and electrically connected in circuit and adapted for energization to produce heat energy for heating said liquid heating fluid.

2. An immersion heater assembly in accordance with claim 1, wherein the individual coil turns of said cable heater structure are axially spaced apart a distance between centers of between one-half and one inch, and has a substantially self-supporting structure for an axial length of six inches or less.

3. An immersion heater assembly in accordance with claim 1, wherein said frame member is of a generally planar, grid-like configuration having at least one window-like opening formed therein, said coil turns being detachably mounted on said frame member and in generally bridging relation relative to said window-like opening.

4. An immersion heater assembly in accordance with claim 1, wherein the coil turns are cylindrically located and spaced around a center post and held in position by generally circular notched discs.

5. An immersion heater assembly in accordance with claim 1, wherein said frame member includes an outwardly extending generally tubular member adapted for receiving interiorly thereof lead wire means for connection to said power source, and living hinge means pivotally connecting said tube member to said frame member.

6. An immersion heater assembly in accordance with claim 1, wherein said inner sheath is made from at least one layer of spirally wrapped tape disposed in overlapping relationship and which has been sintered to form substantially homogeneous polymeric layer.

7. An immersion heater assembly in accordance with claim 6, wherein said sintered homogeneous polymeric layer has been cooled to ambient temperature prior to engagement with said ground wire element.

8. An immersion heater assembly in accordance with claim 7, wherein said sintered homogeneous polymeric layer is made from a plastic material selected from the group consisting essentially of tetrafluoroethylene and fluorinated ethylene propylene polymers, and which has been sintered at a temperature between 500° F. and 700° F. and then cooled to ambient temperature.

9. An immersion heater assembly in accordance with claim 1, wherein said inner sheath is comprised of a spirally wrapped tape layer made from a fluoropolymeric material, and said fluoropolymeric material having a higher temperature resistance then the fluoropolymeric material of said outer tubular sheath.

10. An immersion heater assembly in accordance with claim 9, wherein said inner sheath is comprised of an extruded layer of fluoropolymeric material.

* * * * *